US008393028B2

(12) United States Patent
Namkook et al.

(10) Patent No.: US 8,393,028 B2
(45) Date of Patent: Mar. 12, 2013

(54) METHOD OF MANUFACTURING FOOTWEAR HAVING SIPES

(75) Inventors: Kim Namkook, Busan (KR); Jeffrey L. Johnson, Busan (KR)

(73) Assignee: NIKE, Inc., Beaverton, OR (US)

( * ) Notice: Subject to any disclaimer, the term of this patent is extended or adjusted under 35 U.S.C. 154(b) by 392 days.

(21) Appl. No.: 12/428,501

(22) Filed: Apr. 23, 2009

(65) Prior Publication Data

US 2010/0269271 A1 Oct. 28, 2010

(51) Int. Cl.
*A43D 8/00* (2006.01)
*B26D 1/00* (2006.01)

(52) U.S. Cl. ..... 12/146 B; 12/146 BP; 83/13

(58) Field of Classification Search ..... 12/142 P, 12/146 B, 146 BP, 146 BC, 146 BR, 41.05; 83/171, 861, 879, 880, 883, 856–858, 618, 83/620, 15; 36/25 R
See application file for complete search history.

(56) References Cited

U.S. PATENT DOCUMENTS

| | | | | | |
|---|---|---|---|---|---|
| 460,774 | A | * | 10/1891 | Gibbs | 83/522.24 |
| 500,385 | A | | 6/1893 | Hall | |
| 1,008,640 | A | * | 11/1911 | Greene | 12/146 BP |
| 1,501,072 | A | * | 7/1924 | Stanbon | 83/35 |
| 1,552,608 | A | * | 9/1925 | Hunt et al. | 12/146 B |
| 1,663,587 | A | * | 3/1928 | Dunbar | 264/236 |
| 1,681,970 | A | * | 8/1928 | Bertrand | 12/40 |
| 1,722,315 | A | * | 7/1929 | Sabin | 83/468.93 |
| 1,988,281 | A | * | 1/1935 | Maccarone | 12/146 BP |
| 1,992,250 | A | | 2/1935 | Stacey | |
| 2,010,827 | A | * | 8/1935 | Ray | 264/160 |
| 2,012,915 | A | * | 8/1935 | Maccarone | 12/146 BP |
| 2,104,133 | A | | 1/1938 | Mees | |
| 2,130,188 | A | * | 9/1938 | Kauffman et al. | 101/297 |
| 2,140,478 | A | * | 12/1938 | Mossback | 30/140 |
| 2,162,912 | A | | 6/1939 | Craver | |
| 2,165,842 | A | * | 7/1939 | Eger | 157/13 |
| 2,211,056 | A | * | 8/1940 | Duckoff | 12/142 R |
| 2,275,706 | A | * | 3/1942 | Wales | 83/140 |
| 2,323,809 | A | * | 7/1943 | Flink | 12/41.05 |
| 2,340,582 | A | * | 2/1944 | Cushman | 36/19.5 |
| 2,345,831 | A | * | 4/1944 | Pierson | 36/30 R |
| 2,370,963 | A | * | 3/1945 | Issaly | 264/160 |
| 2,379,003 | A | * | 6/1945 | Hedberg | 83/143 |
| 2,380,227 | A | * | 7/1945 | Freeman, Jr. | 12/40 |
| 2,561,050 | A | | 7/1951 | Charron et al. | |
| 2,608,498 | A | * | 8/1952 | Kennedy | 156/95 |
| 2,689,609 | A | * | 9/1954 | Butler | 83/658 |
| 3,012,599 | A | * | 12/1961 | Benson et al. | 152/209.22 |
| 3,089,164 | A | | 5/1963 | Meserve | |

(Continued)

FOREIGN PATENT DOCUMENTS

GB 2008384 A 6/1979

OTHER PUBLICATIONS

International Search Report and Written Opinion issued Jul. 28, 2010, in corresponding PCT Application No. PCT/US2010/031710.

*Primary Examiner* — Darnell Jayne
*Assistant Examiner* — Kimberley S Wright
(74) *Attorney, Agent, or Firm* — Banner & Witcoff, Ltd.

(57) ABSTRACT

A method of manufacturing footwear including the steps of positioning a sole member on a first portion of a cutting assembly; heating a second portion of the cutting assembly, the second portion including a cutting die; pressing the heated cutting die into the sole member to form a plurality of sipes in the sole member; and removing the cutting die from the sole member.

24 Claims, 4 Drawing Sheets

U.S. PATENT DOCUMENTS 3,293,494 A * 12/1966 Fischer ..... 361/224
3,295,230 A 1/1967 Szerenyi et al.
3,524,370 A * 8/1970 Thompson ..... 83/255
3,587,377 A * 6/1971 Albert ..... 83/171
3,808,713 A 5/1974 Dassler
4,193,155 A * 3/1980 Borisuck et al. ..... 12/40
4,306,607 A * 12/1981 Curry ..... 157/13
4,309,831 A 1/1982 Pritt
4,338,839 A * 7/1982 Farrell et al. ..... 83/620
4,718,629 A * 1/1988 Block et al. ..... 248/363
4,760,652 A 8/1988 Austin
5,012,597 A 5/1991 Thomasson
5,405,123 A * 4/1995 Mielenz ..... 269/21
5,624,298 A * 4/1997 Yumoto ..... 451/28
5,699,628 A 12/1997 Boatwalla
6,105,279 A 8/2000 Bouchoms
6,115,945 A 9/2000 Ellis, III
6,140,602 A 10/2000 Costin
6,202,325 B1 3/2001 Kim
6,252,196 B1 6/2001 Costin et al.
6,295,744 B1 10/2001 Ellis, III
6,315,202 B2 11/2001 Costin et al.
6,516,541 B2 2/2003 Cagner
6,574,889 B2 6/2003 Cagner
7,171,767 B2 2/2007 Hatfield et al.
7,290,357 B2 11/2007 McDonald et al.
7,392,605 B2 7/2008 Hatfield et al.
2005/0081691 A1* 4/2005 Shteyngarts ..... 83/171
2006/0061012 A1 3/2006 Hatfield et al.
2007/0094896 A1 5/2007 Hatfield et al.
2007/0169376 A1 7/2007 Hatfield et al.
2007/0169379 A1 7/2007 Hazenberg et al.
2008/0022553 A1 1/2008 McDonald et al.
2011/0253316 A1* 10/2011 Kost ..... 156/761

* cited by examiner

METHOD OF MANUFACTURING FOOTWEAR HAVING SIPES

FIELD

Aspects of this invention relate generally to footwear, and, in particular, to a method of manufacturing footwear having sipes formed therein.

BACKGROUND

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers or sole members that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethyl vinyl acetate (EVA), that extends throughout the length of the footwear, often by way of an injection molding process. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators. Sipes may be formed in the sole structure of the footwear, providing increased flexibility for the footwear.

It would be desirable to provide a method of manufacturing footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a method of manufacturing an article of footwear having sipes formed in a sole member thereof. In accordance with a first illustrative aspect, a method of manufacturing footwear including the steps of positioning a sole member on a first portion of a cutting assembly; heating a second portion of the cutting assembly, the second portion including a cutting die; pressing the heated cutting die into the sole member to form a plurality of sipes in the sole member; and removing the cutting die from the sole member.

In accordance with another illustrative aspect, a method of manufacturing footwear includes the steps of positioning a sole member on a jig of a first portion of a cutting assembly; heating a second portion of the cutting assembly to selected temperature, the second portion including a cutting die having a plurality of blades; pressing the blades into the sole member for a selected period of time to form a plurality of sipes in the sole member; and removing the cutting die from the sole member.

In accordance with a further illustrative aspect, a method of manufacturing footwear comprising the steps of positioning a sole member on a jig of a first portion of a cutting assembly, the jig including a base member and a plurality of pins positioned about a periphery of the base member, the first portion including a plurality of upwardly extending projections; heating a cutting die of the second portion to a temperature between approximately 160° C. and approximately 220° C., the cutting die having a plurality of blades and a plurality of recesses, each recess configured to receive one of the projections of the first portion; pressing the blades into the sole member for a period of time between approximately 2 seconds and approximately 15 seconds to form a plurality of sipes in the sole member; and removing the cutting die from the sole member.

These and additional features and advantages disclosed here will be further understood from the following detailed disclosure of certain embodiments.

Figure 1:
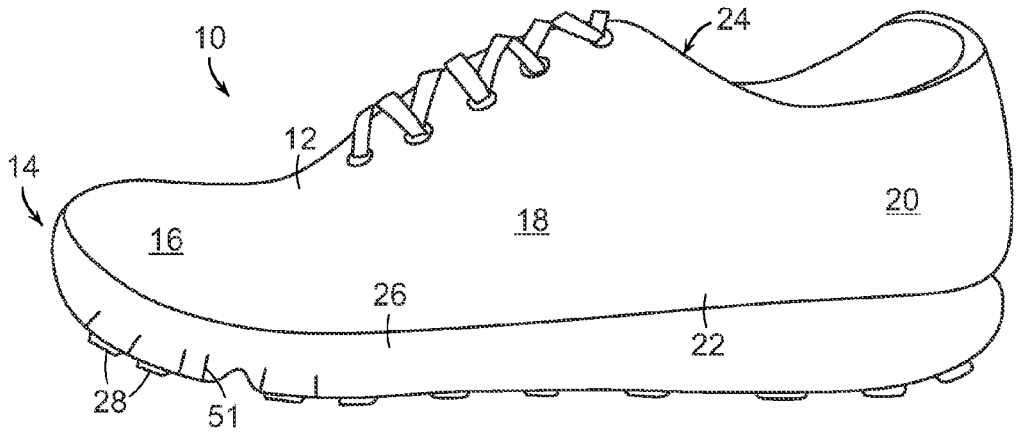
FIG. 1 is a perspective view of an article of footwear having sipes formed in a sole structure thereof.

The figures referred to above are not drawn necessarily to scale, should be understood to provide a representation of particular embodiments of the invention, and are merely conceptual in nature and illustrative of the principles involved. Some features of the mold assembly used to modify an article of footwear depicted in the drawings have been enlarged or distorted relative to others to facilitate explanation and understanding. The same reference numbers are used in the drawings for similar or identical components and features shown in various alternative embodiments. Mold assemblies used to modify an article of footwear as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of a method of modifying a sole structure for an article of footwear to provide sipes in a lower surface of the sole structure. The sole structure may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 2:
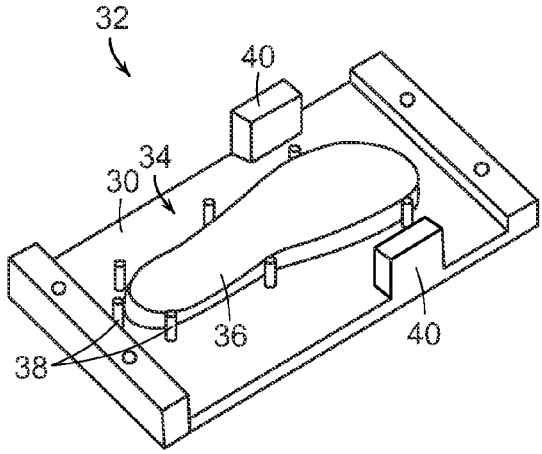
FIG. 2 is a perspective view of a bottom plate and jig of a mold assembly used to modify the sole structure of FIG. 1.

An article of footwear 10 is depicted in FIG. 1 as including an upper 12 and a sole structure 14. For reference purposes, footwear 10 may be divided into three general portions: a forefoot portion 16, a midfoot portion 18, and a heel portion 20, as shown in FIGS. 1 and 2. Footwear 10 also includes a lateral side 22 and a medial side 24. Forefoot portion 16 generally includes portions of footwear 10 corresponding with the toes and the joints connecting the metatarsals with the phalanges. Midfoot portion 18 generally includes portions of footwear 10 corresponding with the arch area of the foot, and heel portion 20 corresponds with rear portions of the foot, including the calcaneus bone. Lateral side 22 and medial side 24 extend through each of portions 16-20 and correspond with opposite sides of footwear 10.

Portions 16-20 and sides 22-24 are not intended to demarcate precise areas of footwear 10. Rather, portions 16-20 and sides 22-24 are intended to represent general areas of footwear 10 to aid in the following discussion. In addition to footwear 10, portions 16-20 and sides 22-24 may also be applied to upper 12, sole structure 14, and individual elements thereof.

The figures illustrate only an article of footwear intended for use on the left foot of a wearer. One skilled in the art will recognize that an article of footwear for the right foot of a wearer, such article being the mirror image of the left, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Upper 12 forms an interior void that comfortably receives a foot and secures the position of the foot relative to sole structure 14. The configuration of upper 12, as depicted, is suitable for use during athletic activities that involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole structure 14 may be secured to upper 12 by an adhesive, or any other suitable fastening means. Sole structure 14, which is generally disposed between the foot of the wearer and the ground, provides attenuation of ground reaction forces (i.e., imparting cushioning), traction, and may control foot motions, such as pronation. As with conventional articles of footwear, sole structure 14 includes a plurality of sole members including an insole (not shown) located within upper 12, a midsole 26, and an outsole 28. Midsole 26 is attached to upper 12 and functions as the primary shock-attenuating and energy-absorbing component of footwear 10. Outsole 28 is attached to the lower surface of midsole 26 by adhesive or other suitable means. Suitable materials for outsole 28 include traditional rubber materials. Other suitable materials for outsole 28 will become readily apparent to those skilled in the art, given the benefit of this disclosure. In certain embodiments, sole structure 14 may not include an outsole layer separate from midsole 26 but, rather, the outsole may comprise a bottom surface of midsole 26 that provides the external traction surface of sole structure 14.

The present invention may be embodied in various forms. A first portion or bottom plate 30 of an embodiment of a cutting assembly 32 used in the manufacture of an article of footwear is shown in FIG. 2. Bottom plate 30 includes a jig 34 used to hold a sole member such as midsole 26 in place during formation of sipes in midsole 26. Jig 34 includes a base member 36, having an outline generally conforming to an outline of midsole 26, and a plurality of pins 38 positioned about a periphery of base member 36 and extending upwardly from bottom plate 30. A pair of stopping members 40 extends upwardly from bottom plate 30.

Figure 3:
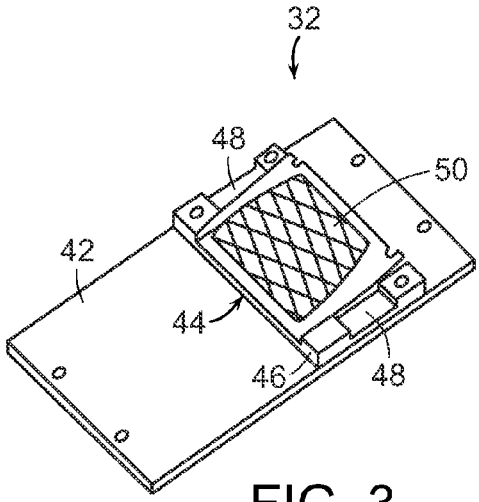
FIG. 3 is a perspective view of a cutting die of the mold assembly used to modify the sole structure of FIG. 1.
Figure 4:
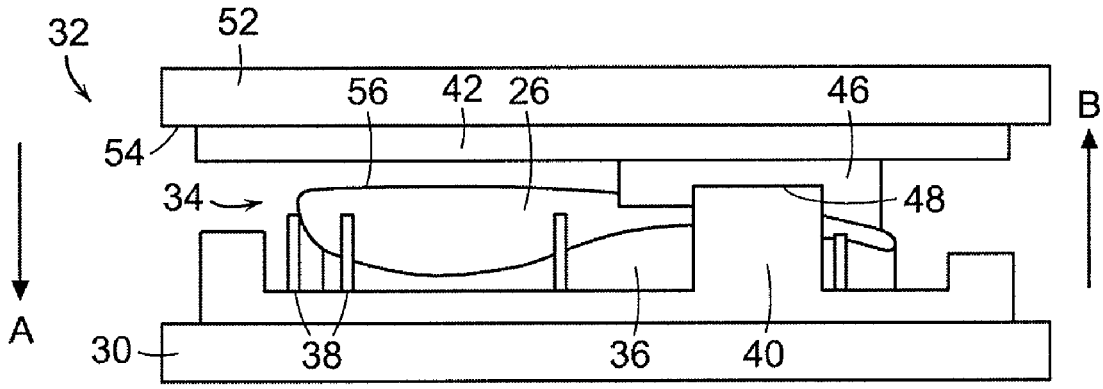
FIG. 4 is an elevation view of the mold assembly used to modify the midsole of FIG. 1, shown in use with sipes being formed in the sole structure.

A cutting die 42 of cutting assembly 32 is seen in FIG. 3, and includes a blade assembly 44. Blade assembly 44 includes a base portion 46 having a pair of recesses 48 formed therein, each of which receives a stopping member 40 of bottom plate 30 when cutting assembly 32 is in its assembled in-use condition, as seen if FIG. 4. Blade assembly 44 includes at least one blade 50. In the illustrated embodiment, blade assembly 44 includes a plurality of blades 50. Blades 50 can be oriented in any desired position. As illustrated here blades 50 are positioned in two sets of parallel blades, with each set angled with respect to the other to form a grid having a criss-cross pattern.

In certain embodiments blades 50 may be made of steel, e.g., hard steels such as S45C steel, S50C steel, and S55C. Other suitable materials for blades 50 will become readily apparent to those skilled in the art, given the benefit of this disclosure.

To form sipes 51 (seen in FIG. 5) in midsole 26, midsole 26 is placed in an inverted position on base member 36 of jig 34 and is held in place there between pins 38. A second portion or top plate 52 of cutting assembly 32 is positioned above bottom plate 30, with cutting die 42 secured to a bottom surface 54 of top plate 52. Top plate 52 is then heated, which in turn causes blades 50 to be heated. Top plate 52 is then moved downwardly in the direction of arrow A such that heated blades 50 are pressed into the lower surface 56 of midsole 26 (seen here as the top surface of midsole 26 since midsole 26 is in an inverted position).

It is to be appreciated that, in certain embodiments, heated top plate 52 could remain stationary and bottom plate 30 could be moved upwardly in the direction of arrow B until blades 50 are pressed into midsole 26. In yet other embodiments, heated top plate 52 could move downwardly in the direction of arrow A, and bottom plate 30 could move upwardly in the direction of arrow B to cause blades 50 to knife into midsole 26.

Top plate 52 is held in this position with heated blades 50 embedded within midsole 26 for a selected time period. In certain embodiments, blades 50 are embedded within midsole for between approximately 2 seconds and approximately 15 seconds, more preferably between approximately 5 seconds and approximately 15 seconds, and most preferably approximately 2-3 seconds, thereby forming sipes 51.

In certain embodiments, top plate 52 and blades 50 are heated such that blades 50 reach a temperature between approximately 160° C. and approximately 220° C.

Top plate 52 is then moved upwardly in the direction of arrow B (or bottom plate 30 is moved downwardly, or top plate 52 is moved upwardly and bottom plate 30 is moved downwardly) such that blades 50 are free of midsole 26. Midsole 26 is then removed from jig 34 and, as seen in FIG. 5, sipes 51 can be seen as formed in lower surface 56 of midsole 26.

Figure 5:
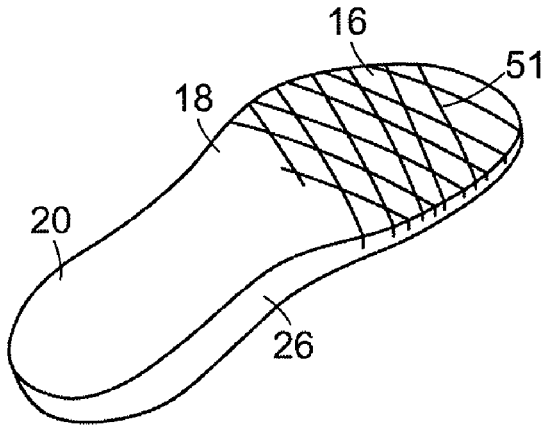
FIG. 5 is a bottom perspective view of the sole structure of FIG. 1, shown with sipes formed in its lower surface.
Figure 8:
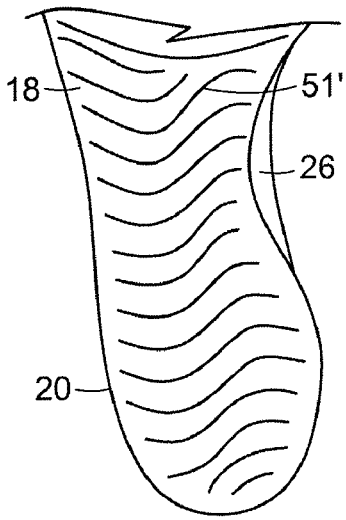
FIG. 8 is a plan view of an alternative embodiment of a sole structure with sipes formed in its lower surface.
Figure 9:
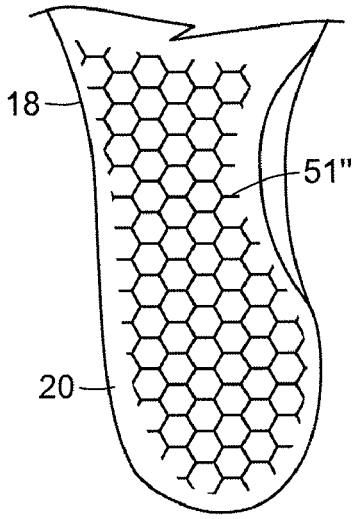
FIG. 9 is a plan view of a further embodiment of a sole structure with sipes formed in its lower surface.

In certain embodiments, as seen in FIGS. 1 and 5, at least some of sipes 51 extend completely to the peripheral edge of midsole 26 and, therefore, are visible on the sidewall of midsole 26. In other embodiments, as illustrated in FIGS. 8 and 9, sipes 51 do not extend to the peripheral edge of midsole 26 and, therefore, are not visible on the sidewall of midsole 26.

In known fashion, upper 12 is then secured to midsole 26 with adhesive or other suitable fastening means. In the embodiment illustrated above, cutting assembly 32 is used to create sipes in midsole 26. In such an embodiment, an outsole 28 may be secured to midsole 26 in known fashion with adhesive or other suitable fastening means, either after sipes 51 are formed in midsole 26 or beforehand. In certain other embodiments, the sole member in which sipes 51 are formed could include both midsole 26 and outsole 28, that is, sipes 51 could be formed in both midsole 26 and outsole 28 with cutting assembly 32.

It is to be appreciated that, in certain embodiments, midsole 26 could be a sole member formed of a plurality of portions. For example, midsole 26 could be formed of multiple layers. Each of these layers could have properties different than one or more of the other layers. Thus, in certain embodiments, midsole 26 could be formed of a first layer having a first density and a second layer having a second density different from the first density, with sipes 51 extending into both the first and second layers. It is to be appreciated that midsole 26 could also be formed of more than two layers.

Sipes 51 serve to provide increased flexibility for midsole 26, and, therefore, footwear 10. In the illustrated embodiment, sipes 51 are formed in forefoot portion 16 of midsole 26. It is to be appreciated that sipes 51 can be formed in any portion of midsole 26.

Midsole 26 may be formed of urethane, rubber, or phylon (Ethylene Vinyl Acetate ('EVA') foam), for example. Other suitable materials for midsole 26 will become readily apparent to those skilled in the art, given the benefit of this disclosure.

Figure 7:
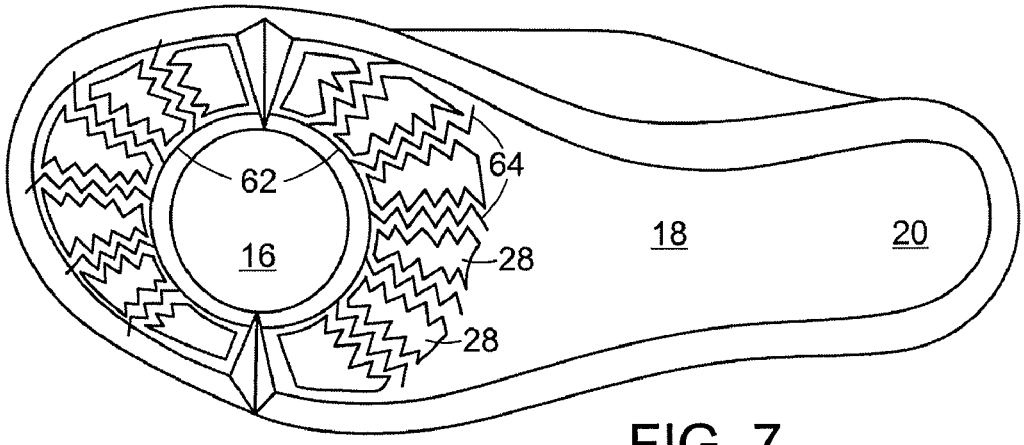
FIG. 7 is a bottom plan view of an article of footwear, shown with sipes formed in its midsole with the cutting die of FIG. 6.
Figure 6:
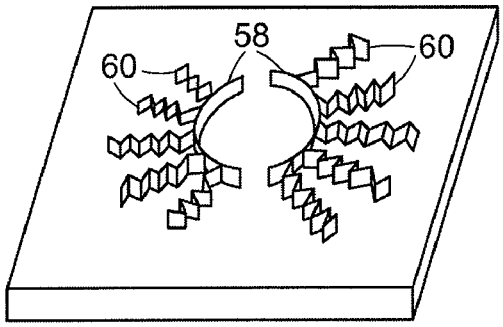
FIG. 6 is a perspective view of another embodiment of a cutting die of a mold assembly used to form sipes in a sole structure.

Another embodiment of a cutting die 42' is seen in FIG. 6. Cutting die 42 includes a pair of curved blades 58 opposed to one another and cooperating to define a majority of a circle. A plurality of radial blades 60 extend radially outward from outer surfaces of curved blades 58. In the illustrated embodiment, each radial blade 60 has a zig-zag form. As seen in FIG. 7, a midsole formed with cutting die 42' has a pair of curved sipes 62 in forefoot portion 16, and a plurality of radially extending sipes 64 extending radially outwardly from curved sipes 62. As seen here, outsole 28 is formed of a plurality of outsole elements 28 positioned between sipes 64.

As noted above, the blades of the cutting die can take any desired shape and be positioned in any desired manner to produce sipes of any desired shape, pattern, and depth. In certain embodiments, the depth of sipes 51 is between approximately 0.5 mm and approximately 50 mm. The actual depth of sipes 51 is dependent on many factors, including the desired flexibility of midsole 26, as well as the original unmodified thickness of midsole 26. In certain embodiments, sipes extend a sufficient depth into midsole 26 such that approximately 2 mm of material remains above sipes 51 in midsole 26. It is to be appreciated that in other embodiments that sipes 51 may extend further into midsole 26, and that in some embodiments, one or more sipes 51 could extend completely through midsole 26.

Another embodiment of midsole 26 is seen in FIG. 8, with a plurality of sipes 51' formed therein. Sipes 51' have the shape of compound curves, that is, lines that curve in more than one direction. Sipes 51' extend through midsole portion 18 and heel portion 20 of midsole 26. Yet another embodiment of midsole 26 is seen in FIG. 9, in which sipes 51" form a honeycomb pattern, and extend through midsole portion 18 and heel portion 20 of midsole 26. Thus, it can be appreciated, as noted above, that the sipes can take on any desired shape and be positioned in any desired location in midsole 26.

It is to be appreciated that some or all of the sipes formed in midsole 26 may be interconnected with other sipes, a seen in the embodiments illustrated in FIGS. 5, 7, and 9, or each sipe may be separate and spaced from each other sipe, as illustrated in FIG. 8. In other embodiments, some of the sipes could be separate and spaced from other sipes while some of the sipes could be interconnected with some of the other sipes.

The abutment of stopping member 40 with recess 48 helps control the depth of sipes 51. In certain embodiments, a separate height controlling mechanism (not shown) can be used to control the amount that top plate 52 moves downwardly, thereby controlling the depth of sipes 51. Similarly, in embodiments where bottom plate 30 moves upwardly, the height controlling mechanism can control the amount of movement of bottom plate 30 to control the depth of sipes 51. In yet other embodiments, where top plate 52 moved downwardly and bottom plate 30 moves upwardly, the height controlling mechanism can control the amount of movement of bot bottom plate 30 and top plate 52 to regulate the depth of sipes 51.

In certain embodiments, blades 50 of cutting die 42 can be cleaned, such as with an electric bush, to remove any residual material and ensure that further cuts are clean and sharp. In certain embodiments, blades 50 may be cleaned after cutting through 100 midsoles.

Figure 10:
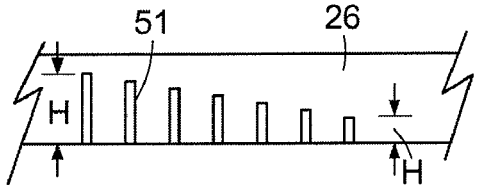
FIG. 10 is an elevation view of an alternative embodiment of a sole structure of an article of footwear with sipes formed therein.

In certain embodiments, as illustrated in FIG. 10, the height H of sipes 51 can vary along midsole 26. In other embodiments, as seen in FIGS. 1 and 5, the height H of sipes 51 is constant along midsole 26.

In the embodiment illustrated above, it can be seen that cutting assembly 32 is configured to form sipes 51 in a single midsole 26 of article of footwear 10. It is to be appreciated that, in certain embodiments, a plurality of midsoles 26 can be modified by cutting assembly 32 to include sipes 51. As seen in the embodiment illustrated in FIG. 11, a first portion of a cutting assembly 32 is configured to modify a mating pair of midsoles 26. It is to be appreciated that any number of midsoles 26 can be modified by cutting assembly 32.

Figure 11:
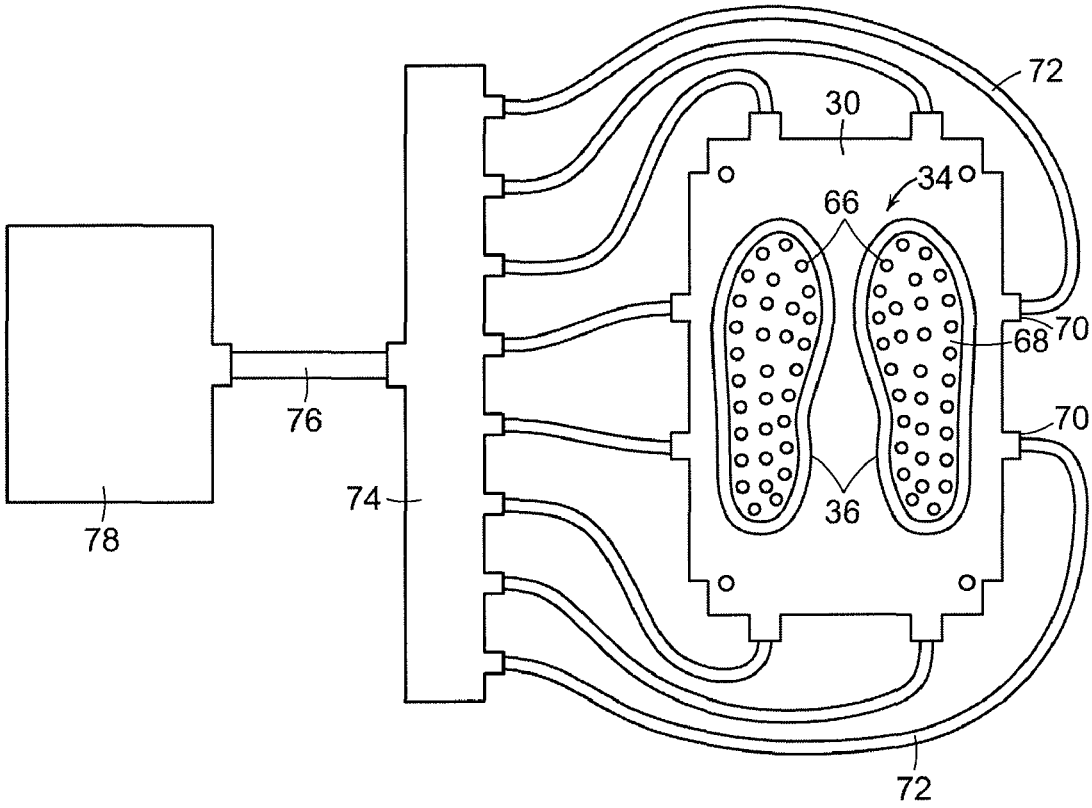
FIG. 11 is a plan view of an alternative embodiment of a bottom plate and jig of a mold assembly used to modify a pair of sole structures.

In certain embodiments, midsole 26 can be secured to bottom plate 30 through the use of vacuum clamping. As illustrated in FIG. 11, a plurality of apertures 66 is formed in an upper surface 68 of base member 36 of jig 34. Apertures 66 are in fluid communication with outlet ports 70 formed in bottom plate 30 by way of channels (not visible) extending through bottom plate 30. A plurality of first conduits such as first hoses 72 extend between outlet ports 70 and a manifold 74. A second conduit such as a second hose 76 extends between manifold 74 and a vacuum motor 78. When midsole 26 is placed on base member 36 and vacuum motor 78 is turned on, the vacuum created beneath midsole 26 secures midsole 26 to base member 36 of bottom plate 30.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A method of manufacturing footwear comprising the steps of:

positioning a sole member on a first portion of a cutting assembly, a plurality of pins projecting upwardly from the first portion such that the plurality of pins are positioned along each of a medial side and a lateral side of the sole member and the sole member is positioned between and in abutting relationship with each of the plurality of the pins;

heating a second portion of the cutting assembly, the second portion including a cutting die;

pressing the heated cutting die into the sole member to simultaneously form a plurality of sipes in the sole member; and removing the cutting die from the sole member.

2. The method of manufacturing footwear of claim 1, wherein the cutting die includes at least one blade.

3. The method of manufacturing footwear of claim 1, wherein the cutting die includes a plurality of blades.

4. The method of manufacturing footwear of claim 1, wherein the first portion includes a bottom plate.

5. The method of manufacturing footwear of claim 1, wherein the first portion includes a jig.

6. The method of manufacturing footwear of claim 5, wherein the jig includes a base member and the plurality of pins are positioned about a periphery of the base member.

7. The method of manufacturing footwear of claim 5, wherein the jig includes a plurality of upwardly extending projections.

8. The method of manufacturing footwear of claim 7, wherein the cutting die includes a plurality of recesses, each recess receiving one of the projections of the jig.

9. The method of manufacturing footwear of claim 1, wherein the cutting die is heated to between approximately 160° C. and approximately 220° C.

10. The method of manufacturing footwear of claim 1, wherein the cutting die is pressed into the sole member for approximately 2 seconds to approximately 15 seconds.

11. The method of manufacturing footwear of claim 1, wherein a depth of the sipes is between approximately 0.5 mm and approximately 50 mm.

12. The method of manufacturing footwear of claim 1, further comprising the step of securing an upper to the sole member.

13. The method of manufacturing footwear of claim 1, wherein the sole member is a midsole.

14. The method of manufacturing footwear of claim 13, further comprising the step of securing an outsole to the midsole.

15. The method of manufacturing footwear of claim 1, wherein a height of at least one sipe varies along its length.

16. The method of manufacturing footwear of claim 1, further comprising the step of securing the sole member to the first portion with vacuum clamping.

17. A method of manufacturing footwear comprising the steps of:

positioning a sole member on a jig of a first portion of a cutting assembly, a plurality of pins projecting upwardly from the first portion such that the plurality of pins are positioned along each of a medial side and a lateral side of the sole member and the sole member is positioned between and in abutting relationship with each of the plurality of the pins;

heating a second portion of the cutting assembly to selected temperature, the second portion including a cutting die having a plurality of blades;

pressing the blades into the sole member for a selected period of time to simultaneously form a plurality of sipes in the sole member; and removing the cutting die from the sole member.

18. The method of manufacturing footwear of claim 17, wherein the cutting die is heated to between approximately 160° C. and approximately 220° C.

19. The method of manufacturing footwear of claim 17, wherein the blades are pressed into the sole member for approximately 2 seconds to approximately 15 seconds.

20. The method of manufacturing footwear of claim 17, wherein a depth of the sipes is between approximately 0.5 mm and approximately 50 mm.

21. The method of manufacturing footwear of claim 17, further comprising the step of securing an upper to the sole member.

22. The method of manufacturing footwear of claim 17, wherein the sole member is a midsole.

23. The method of manufacturing footwear of claim 22, further comprising the step of securing an outsole to the midsole.

24. A method of manufacturing footwear comprising the steps of:

positioning a sole member on a jig of a first portion of a cutting assembly, the jig including a base member and a plurality of pins positioned about a periphery of the base member, the first portion including a plurality of upwardly extending projections;

heating a cutting die of the second portion to a temperature between approximately 160° C. and approximately 220° C., the cutting die having a plurality of blades and a plurality of recesses, each recess configured to receive one of the projections of the first portion;

pressing the blades into the sole member for a period of time between approximately 2 seconds and approximately 15 seconds to form a plurality of sipes in the sole member; and removing the cutting die from the sole member.

* * * * *